US011554938B2

(12) United States Patent
Lindberg et al.

(10) Patent No.: US 11,554,938 B2
(45) Date of Patent: Jan. 17, 2023

(54) HOISTING ARRANGEMENT OF A HOIST OF A CRANE

(71) Applicant: KONECRANES GLOBAL CORPORATION, Hyvinkää (FI)

(72) Inventors: Teppo Lindberg, Hyvinkää (FI); Henri Helkiö, Hyvinkää (FI); Atte Lähteenmäki, Hyvinkää (FI); Henri Kokko, Hyvinkää (FI); Niko Laukkanen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 274 days.

(21) Appl. No.: 16/648,425

(22) PCT Filed: Sep. 21, 2018

(86) PCT No.: PCT/FI2018/050685
§ 371 (c)(1),
(2) Date: Mar. 18, 2020

(87) PCT Pub. No.: WO2019/058030
PCT Pub. Date: Mar. 28, 2019

(65) Prior Publication Data

US 2021/0362986 A1 Nov. 25, 2021

(30) Foreign Application Priority Data

Sep. 22, 2017 (FI) ..... 20175847

(51) Int. Cl.
*B66C 11/00* (2006.01)
*B66C 11/20* (2006.01)
(Continued)

(52) U.S. Cl.
CPC ..... *B66C 11/20* (2013.01); *B66C 6/00* (2013.01); *B66C 7/02* (2013.01); *B66D 1/36* (2013.01)

(58) Field of Classification Search
None
See application file for complete search history.

(56) References Cited

U.S. PATENT DOCUMENTS 4,949,855 A * 8/1990 Foit ..... B66C 13/06 212/274
5,461,985 A 10/1995 Gersemsky
(Continued)

FOREIGN PATENT DOCUMENTS

CN 202208605 U 5/2012
CN 103318760 A 9/2013
(Continued)

OTHER PUBLICATIONS

Chinese Office Action and Search Report for Chinese Application No. 201880059996.X, dated Dec. 17, 2020, with English translation of the Office Action.
(Continued)

*Primary Examiner* — Emmanuel M Marcelo
(74) *Attorney, Agent, or Firm* — Birch, Stewart, Kolasch & Birch, LLP

(57) ABSTRACT

The hoisting arrangement of a hoist of a of a crane, includes a trolley arranged to move along a main support structure of the crane, whereby the trolley includes a support frame structure; bearing wheels which are fastened to the support frame structure and by means of which the trolley is arranged to move along said main support structure; a hoisting mechanism that has a rope drum for a hoisting rope, a rope pulley arrangement which has upper sheave arrangements and lower rope pulley arrangements and through which the hoisting rope may be guided from the rope drum
(Continued)

to an attachment point, and a hoisting member in cooperation with the hoisting rope for hoisting a load; whereby the rope drum is supported to the support frame structure of the trolley so that the axle of the rope drum is parallel to the main support structure. In the hoisting arrangement, the disengagement point of the hoisting rope from the rope drum, the attachment point of the sheave, and the attachment point of the first end of hoisting rope are arranged on the same vertical plane of the hoisting arrangement. The rope drum has a first end towards which the hoisting rope is wound in the hoisting member's upper position, and a second end towards which the hoisting rope is unwound in the hoisting member's lower position. The first rope pulley of the rope pulley arrangement is so placed that the release point of the hoisting rope from the first rope pulley to the first sheave is, in the axle direction of the rope drum, further from the second end than the first end of the rope drum.

17 Claims, 6 Drawing Sheets

(51) Int. Cl.

| | |
|---|---|
| ***B66C 6/00*** | (2006.01) |
| ***B66C 7/02*** | (2006.01) |
| ***B66D 1/36*** | (2006.01) |

(56) References Cited

U.S. PATENT DOCUMENTS

| | | | | |
|---|---|---|---|---|
| 5,921,092 | A * | 7/1999 | Behr | A47F 3/0482 62/81 |
| 2005/0092201 | A1 | 5/2005 | Winter et al. | |
| 2017/0029251 | A1 | 2/2017 | Lindberg et al. | |

FOREIGN PATENT DOCUMENTS

| | | | | |
|---|---|---|---|---|
| CN | 106061884 | A | 10/2016 | |
| DE | 2012771 | | 12/1970 | |
| JP | 2001-2379 | A | 1/2001 | |
| JP | 2004-155580 | A | 6/2004 | |
| SU | 1555262 | A1 | 4/1990 | |
| WO | WO 2015/110706 | A1 | 7/2015 | |
| WO | WO 2017/168048 | A1 | 10/2017 | |
| WO | WO 2017216425 | A1 * | 12/2017 | B66D 1/30 |

OTHER PUBLICATIONS

Extended European Search Report for European Application No. 18857977.5, dated Oct. 28, 2020.
International Search Report, issued in PCT/FI2018/050685, dated Dec. 11, 2018.
Written Opinion of the International Searching Authority, issued in PCT/FI2018/050685, dated Dec. 11, 2018.
Russian Decision on Granting and Search Report for Russian Application No. 2020113219, dated Nov. 23, 2020, with English translation.

* cited by examiner

HOISTING ARRANGEMENT OF A HOIST OF A CRANE

BACKGROUND OF THE INVENTION

The invention relates to a hoisting arrangement of a hoist of a crane, comprising a trolley, arranged to move along a main support structure of the crane, whereby the trolley comprises a frame structure; bearing wheels which are fastened to the frame structure and by means of which the trolley is arranged to move along said main support structure; a hoisting mechanism that has a rope drum for a hoisting rope, a rope pulley arrangement which has upper sheave arrangements and lower rope pulley arrangements and through which the hoisting rope may be guided from the rope drum to a attachment point, and a hoisting member in cooperation with the hoisting rope for hoisting a load; whereby the rope drum is supported to the support frame structure of the trolley so that the axle of the rope drum is parallel to the main support structure.

A crane type, often used in industry, is a bridge crane which consists of a bridge running on a rail or rails, a trolley running on the bridge, and a hoist for a load, fixed to the trolley. The hoist of a bridge crane is typically a rope crane. It is important for the usability of a crane that it makes efficient use of the available working space.

In such a case, the hoisting arrangement of a rope hoist is advantageous to be such that it allows hoisting a load as high as possible, using the available free height. Yet, the rope arrangement must be economical to manufacture whereby when the hoist is at its upper position, the rope forces must not increase with the demand for more expensive roping. The rope arrangement must also be reliable, for example when the hoist is at its upper position the risk of the hoisting hook and pulley tipping over to their side must be minimized.

BRIEF DESCRIPTION OF THE INVENTION

An object of the invention is thus to provide an arrangement that allow the aforementioned problems to be solved. The object of the invention is achieved by an arrangement which is characterized by what is disclosed in the independent claims. Preferred embodiments of the invention are disclosed in the dependent claims.

The invention is based on a hoisting arrangement of a hoist of a crane. The hoisting arrangement comprises a trolley which is arranged to move along a main support structure of the crane, whereby the trolley comprises a support frame structure; bearing wheels which are fastened to the support frame structure and by means of which the trolley is arranged to move along said main support structure; a hoisting mechanism that has a rope drum for a hoisting rope, rope pulley arrangements which have upper sheave arrangements and lower rope pulley arrangements and through which the hoisting rope may be guided from the rope drum to a attachment point, and a hoisting member in cooperation with the hoisting rope for hoisting a load. The rope drum is supported to the support frame structure of the trolley so that an axle of the rope drum is parallel to the main support structure. In the hoisting arrangement, the disengagement point of the hoisting rope from the rope drum, the attachment point of the sheave, and the attachment point of the hoisting rope are arranged at the same vertical plane of the hoisting arrangement. The rope drum has a first end towards which the hoisting rope is wound in the hoisting member's upper position, and a second end towards which the hoisting rope is unwound in the hoisting member's lower position. The first rope pulley of the rope pulley arrangement is so placed that the release point of the hoisting rope from the first rope pulley to the first sheave is, in the axle direction of the rope drum, further from the second end than the first end of the rope drum.

The advantage of the inventive hoisting arrangement of a rope hoist is the small height dimension, allowing hoisting a load as high as possible, making use of the available free height.

BRIEF DESCRIPTION OF THE FIGURES

The invention will now be described in more detail in connection with preferred embodiments and with reference to the accompanying drawings, in which.

DETAILED DESCRIPTION OF THE INVENTION

The hoisting arrangement of a trolley of a crane may be used, for example, in a trolley of a bridge crane. The trolley 1 moves along a main support structure 2 of a crane. The main support structure 2 typically comprises profile beam whereby the trolley 1 is supported on a lower flange of the profile beam. So, a main support refers to a supporting structure which, at its simplest, is one beam. If there are a plurality of main supports in the hoisting arrangement, such as two, the main support and its direction refer to the superposed plane of the vertical principal inertias of the supporting structure. The hoisting arrangement of a rope hoist is arranged in a trolley 1.

Figure 7A:
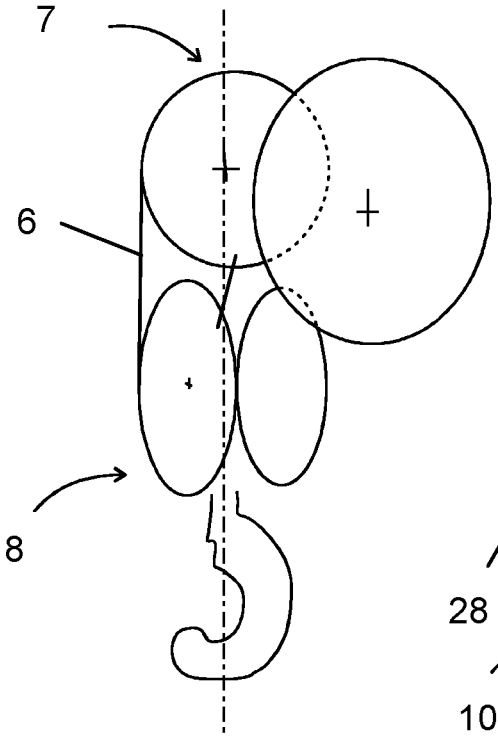
FIGS. 7*a-b* shows a hoisting arrangement of rope hoist.
Figure 7B:
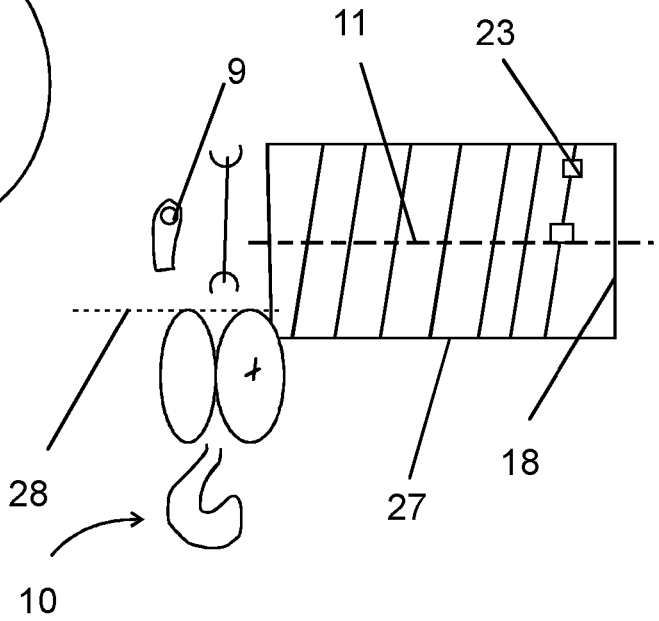
Figure 8:
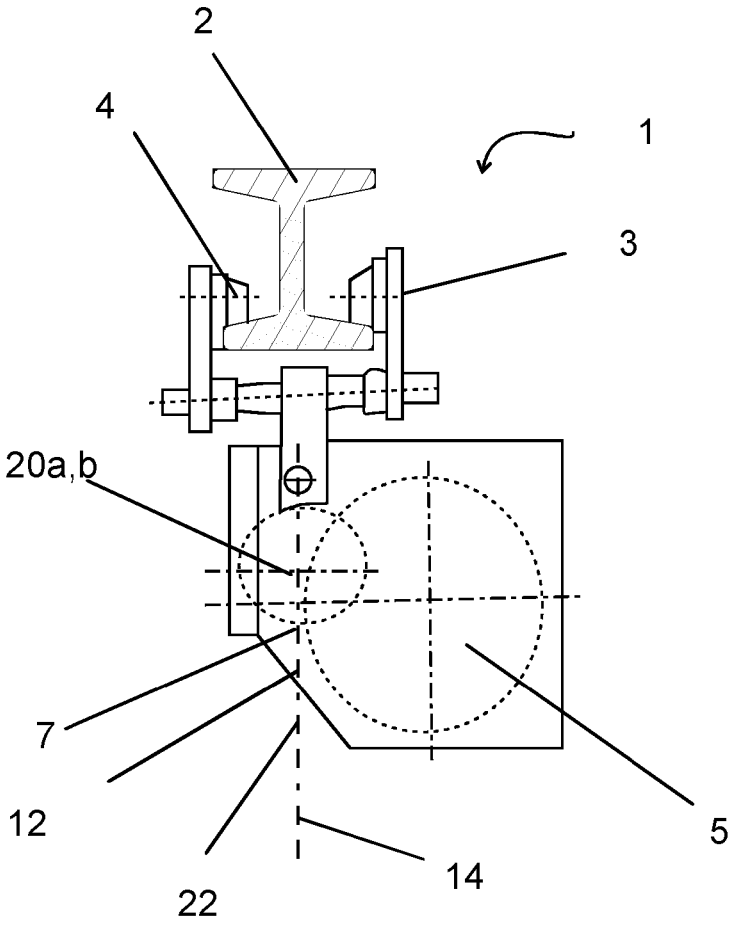
FIG. 8 shows an inventive hoisting arrangement of a trolley of a crane as seen from the direction of the main support.

FIGS. 1 to 8 show a hoisting arrangement comprising a hoist rope of a trolley 1 of a crane. The hoisting arrangement comprises a trolley 1 arranged to move along a main support structure 2 of a crane (FIG. 8). The trolley 1 comprises a support frame structure 3; bearing wheels 4 which are fastened to the support frame structure 3 and by means of which the trolley 1 is arranged to move along said main support structure 2; and a hoisting mechanism having a rope drum 5 with its rope grooves for a hoisting rope 6. The rope drum 5 has a first end 17 towards which the hoisting rope 6 is wound in the hoisting member's upper position 10, and a second end 18 towards which the hoisting rope 6 is unwound in the hoisting members 10 lower position. At the second end 18 of the rope drum, there is a fastening 23 of second end of the rope to the rope drum 5. The hoisting mechanism of the trolley 1 comprises a rope pulley arrangement which has upper sheave arrangements 7 and lower rope pulley arrangements 8 and through which the hoisting rope 6 may be guided from the rope drum 5 to a fixed attachment point 9, and a hoisting member 10 in cooperation with the hoisting rope 6 for hoisting a load. The sheave arrangements 7 are located higher on the rope hoists fixed section, such as the trolley 1 of the rope hoist.

The rope drum 5 is supported to the support frame structure 3 of the trolley so that the axle 11 of the rope drum is parallel to the main support structure 2. In the hoisting arrangement, the disengagement point 12 of the hoisting rope 6 from the rope drum 5, the attachment point 13 of the sheave, and the attachment point 9 of the first end of hoisting rope 6 are arranged at the same vertical plane 14 of the hoisting arrangement. The hoist is supported in relation to this vertical plane 14 so that the vertical plane 14 coincides with the main support, or in the case of a plurality of main supports, coincides with the superposed plane of the vertical principal inertias. The disengagement point 12 from the rope drum 5 is the location at which the hoisting rope 6 leaves the rope groove of the rope drum 5. The attachment point 9 of the first end of the hoisting rope 6 is adapted to the hoisting member 10 of trolley 1. The rope drum 5 has a first end 17 towards which the hoisting rope 6 is wound in the hoisting member's upper position 10, and a second end 18 towards which the hoisting rope 6 is unwound in the hoisting member's 10 lower position. The first rope pulley 8*a* of the rope pulley arrangement 8 is so placed that the release point 15 of the hoisting rope from the first rope pulley 8*a* to the first sheave 7*a* is, in the axle direction of the rope drum 5, further from the second end 18 than the first end 17 of the rope drum 5.

For reasons of clarity, the text uses the terms sheave 7*a-b* for the upper rope pulleys, and the term rope pulley 8*a-c* for the lower rope pulleys.

Advantageously release points 15 and entry points 16 of the hoisting rope 6 between successive rope pulleys 8*a-c* and sheaves 7*a-b* for the hoisting rope 6 are arranged in such a way that tangents arranged at the release point 15 and entry point 16 form a substantially uniform tangent between the rope pulley 8*a-c* and sheave 7*a-b*.

At the release point 15, the hoisting rope 6 leaves the rope groove of the rope pulley 8*a-c*, and at the entry point 16 the hoisting rope 6 makes contact with the rope groove of the rope pulley 8*a-c*. The separation of the hoisting rope 6 or entry of the hoisting rope 6 between the rope pulley 8*a-c* and sheave 7*a-b* changes direction according to the movement of the hoisting rope 6. When hoisted by a hoist, the direction of movement of the hoisting rope 6 is opposite to when being lowered by a hoist. If, for example, when hoisted by a hoist the rope pulley 8*a-c* releases the hoisting rope 6 to the sheave 7*a-b* when being lowered by a hoist, the rope pulley 8*a-c* receives the hoisting rope 6 released by the sheave 7*a-b*.

Figure 1A:
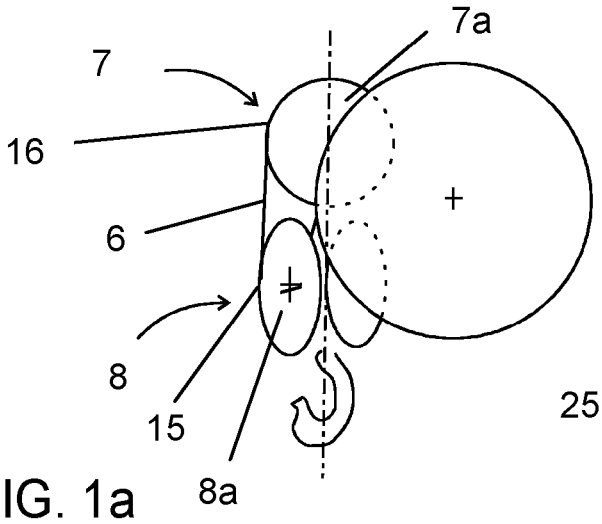
FIGS. 1*a*-1*e* show a hoisting arrangement of a rope hoist.
Figure 1D:
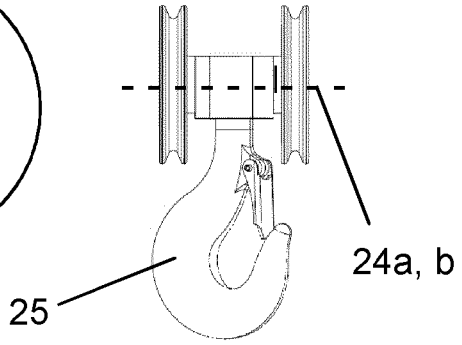
Figure 1B:
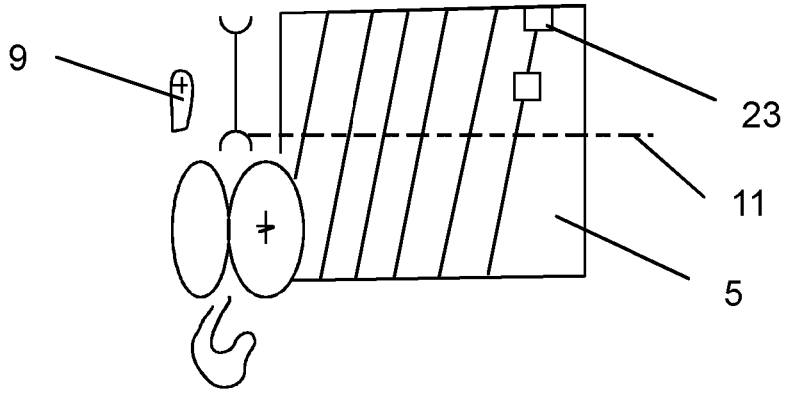

The tangents arranged at the release point 15 and entry point 16 form a substantially uniform tangent between the rope pulley 8*a-c* and sheave 7*a-b* when the directions of rotating axles 11, 24, 20 of successive rotating elements, rope drum 5—rope pulley 8*a-c*—sheave 7*a-b*, are changed in relation to each other. The cylindrical rope drum 5 rotates around its axle 11. A change in the angle of mutually successive rotating axles may be, for example, 90° as in the solutions shown in FIGS. 3*a-d* and 4*a-d*. The change in the direction of the rotating axle is, however, always in an acute angle (more than 0°, less than 90°) when coming from the rope drum 5 on the first rope pulley 8*a*, as shown in the figures. In such a case, the directions of the rotating axles 11, 24*a* of rope drum 5 and the first rope pulley 8*a* of the rope pulley arrangement 8 differ from each other, and the angle between them is smaller than an acute angle (FIGS. 1*a*, 1*e*).

The passing of the hoisting rope 6 between the rope pulleys 8*a-c* and sheaves 7*a-b* and the tangent illustrating it refer to the passing of the hoisting rope 6 so that the hoisting rope sets radially in the groove of the rope pulley 8*a-c* and sheave 7*a-b* and, in addition to this, the hoisting rope 6 sets laterally in the groove of the rope pulley 8*a-c* without a substantial lateral angle error. Avoiding a lateral angle error reduces the wear of the hoisting rope 6 and rope pulley 8*a-c* or sheave 7*a-b*, caused by their flanks contacting each other. An arrangement is used to reduce the lateral angle error, in which successive alternating and rotating members moving the hoisting rope 6 are adapted on rotating axles 11, 20, 24 moving in mutually different directions.

The advantages of the hoisting arrangement are particularly well seen when the rope pulleys are at the upper position, whereby the lengths of the hoisting ropes 6 are relatively short.

At the lower position, the lengths of the hoisting ropes 6 are longer, and the effect of lateral deviations naturally smaller, and deviations do not necessarily exist.

Furthermore, when the location of the flanks or arcs of rotating elements, rope drum 5, rope pulley 8*a-c*, and sheave 7*a-b*, alternates in the vertical directions, they do not hit each other when the hoisting member 10 is hoisted to its upper position. This means that the hoisting arrangement may be made more compact and the hoisting height larger.

FIGS. 1 to 4 and 7 shows a part of the hoisting arrangement comprising a rope hoist of a trolley 1 of a crane so that the hoisting arrangement shows the hoisting rope 6, rope drum 5, lower rope pulley arrangement 8, upper sheave arrangement 7, and a hook 25 of the hoisting member 10 and the frame 26 of the hoisting member (FIGS. 1 to 3).

Figure 5:
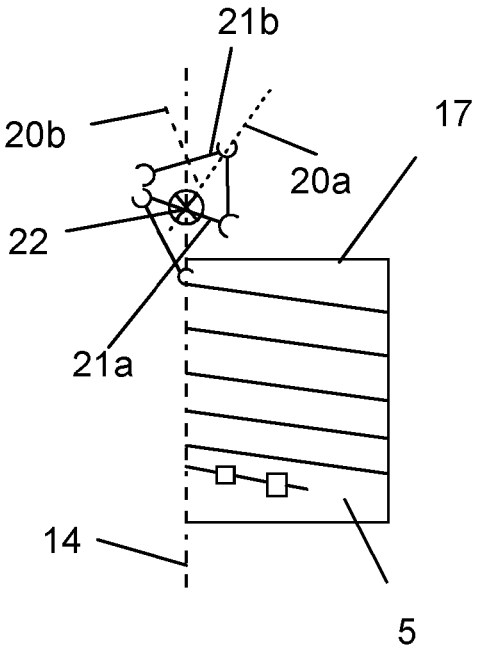
FIG. 5 shows a hoisting arrangement of rope hoist.
Figure 6:
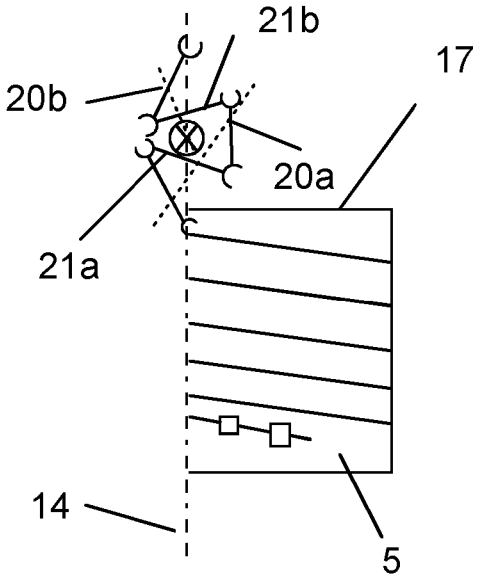
FIG. 6 shows a hoisting arrangement of rope hoist.

FIGS. 5 to 6 shows a part of the hoisting arrangement comprising a rope hoist of a trolley 1 of a crane so that the hoisting arrangement shows the rope drum 5, lower rope pulley arrangement 8, upper sheave arrangement 7, and an attachment point 22 of the hoisting member.

In accordance with the invention, the first rope pulley 8*a* of the rope pulley arrangement 8 is so placed that the release point 15 of the hoisting rope from the first rope pulley 8*a* to the first sheave 7*a* is, in the direction of the axle 11 of the rope drum 5, further from the second end 18 than the first end 17 of the rope drum. In the solution according to FIGS. 1 to 8, the rope pulley arrangement 8 is located, in the direction of the axle 11 of the rope drum 5, at least partly outside the first end 17 of the rope drum 5.

The rope pulleys 8*a-c* and sheaves 7*a-b* have discoidal planes 19*a*, 21*a-b* inside them, defined by their circumferences. The rope pulleys 8*a-c* are arranged in the rope pulley arrangements 8 and the sheaves 7 are arranged in the sheave arrangements 7 so that the discoidal planes 19*a-c*, 21*a-b* of the rope pulleys 8*a-c* and sheaves 7*a-b* are aligned vertically. The rope pulleys 8*a-c* are arranged in the rope pulley arrangements 8 so that the rotating axles 24*a-c* of the rope pulleys are at the same height position, and the sheaves 7*a-b* are arranged in the sheave arrangements 7 so that the rotating axles 20*a-b* of the sheaves are at the same height position.

According to an embodiment, the rope pulley arrangement 8 comprises a first rope pulley 8*a*, which is arranged aslant in relation to a vertical plane 14 of the hoisting arrangement. In such a case, the discoidal plane 19*a* arranged in the vertical direction v of the rope pulley 8*a* and the vertical plane 14 of the hoisting arrangement are at an acute angle in relation to each other.

The first rope pulley 8*a* is arranged at an angle of, for example, 20° . . . 70°, advantageously 40° . . . 50°, in relation to the vertical plane 14 of the hoisting arrangement. The release point 15 of the hoisting rope 6 of the first rope pulley 8*a* is further away from the vertical plane 14 of the hoisting arrangement than the entry point 16 of the hoisting rope.

Figure 2A:
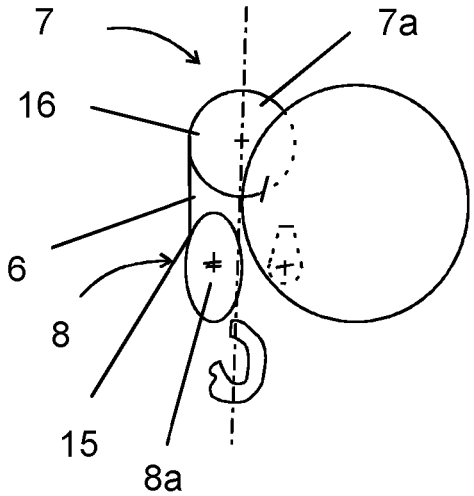
FIGS. 2*a*-2*d* show a hoisting arrangement of a rope hoist.
Figure 2B:
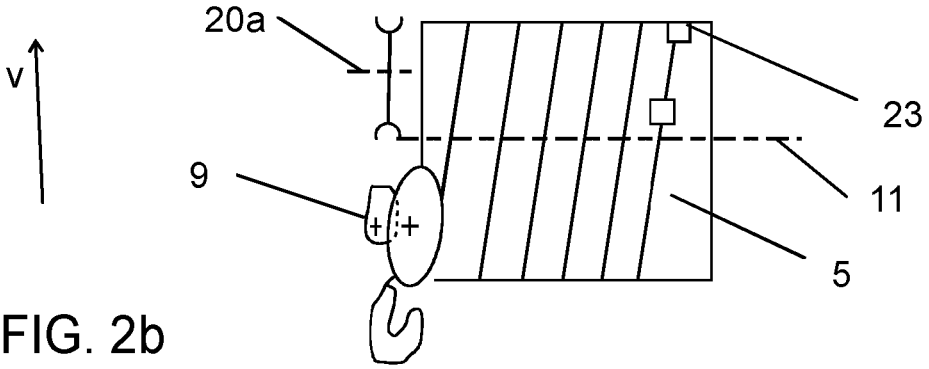
Figure 2C:
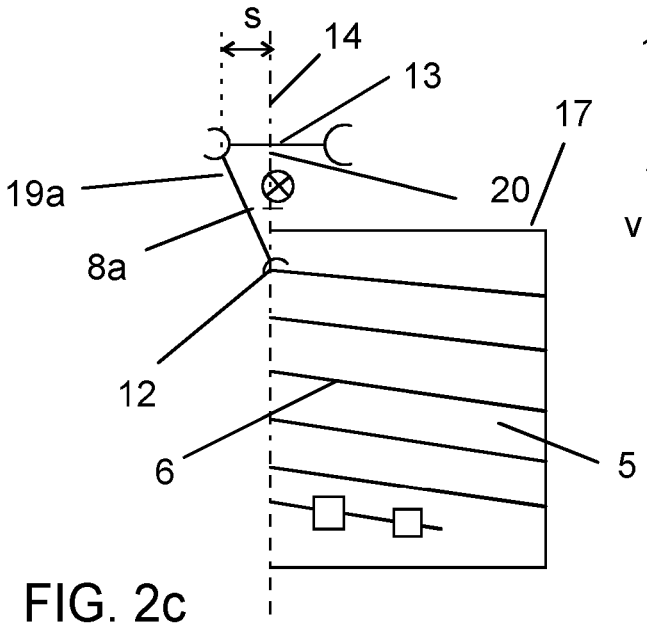
Figure 2D:
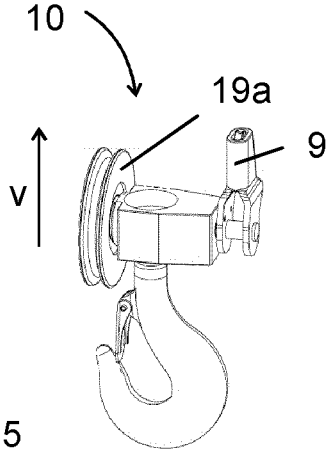

FIGS. 2*a-d* show a solution in which the upper sheave arrangement 7 comprises a sheave 7*a* and the lower rope pulley arrangement 8 comprises a rope pulley 8*a*. The discoidal plane 19*a* of the rope pulley 8*a* is arranged in the vertical direction v. FIG. 2*c* shows the hoisting arrangement from above. The hoisting rope 6 is led from the rope drum 5 to the rope pulley 8*a* having, on its outer edge, a rope pulley groove that guides the hoisting rope 6 obliquely forward, outside the first end 17 of the rope drum as seen in the direction of the axle 11 of the rope drum 5, and to a distance s from the vertical plane 14 of the hoisting arrangement. The discoidal plane 19*a* of the rope pulley and the vertical plane 14 of the hoisting arrangement are at an acute angle in relation to each other. The hoisting rope 6 passes on to the sheave 7*a* above, to its flank further from the rope drum (FIG. 2*a*). From the sheave 7*a*, the hoisting rope 6 descends to the attachment point 9 of the hoisting rope on the hoisting member 10 (FIG. 2*d*). FIGS. 2*a-d* show an 1×3 roping.

According to an embodiment, the rope pulley arrangement also comprises a second rope pulley 8*b*, and the discoidal planes 19*a-b* of the first and second rope pulley are arranged mutually in parallel to an acute angle in relation to the vertical plane 14 of the hoisting arrangement. The second rope pulley 8*a* is beside the first rope pulley in the hoisting member 10. FIGS. 1*a-e* show a solution in which the rope pulley arrangement comprises two parallel rope pulleys 8*a-b*, arranged mutually in an acute angle in relation to the vertical plane of the hoisting arrangement, and the sheave arrangement comprises the sheave 7*a*.

Figure 1C:
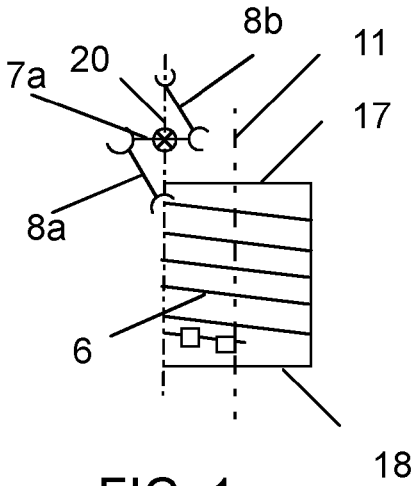
Figure 1E:
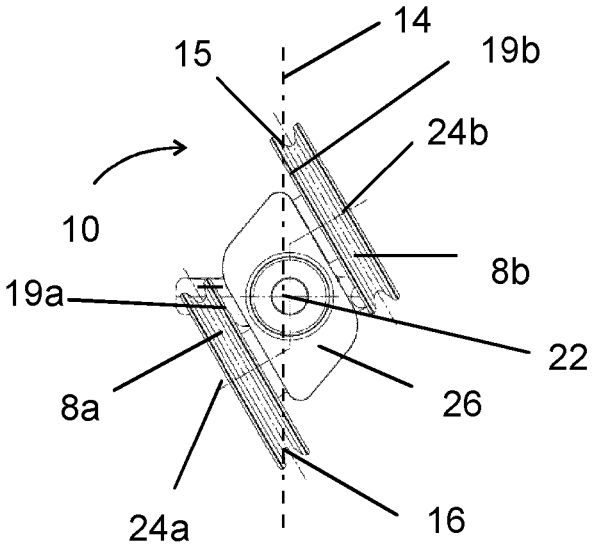

FIG. 1*c* is a top view of the hoisting arrangement. The hoisting rope 6 is led from the rope drum 6 to the first rope pulley 8*a* having, on its outer edge, a rope pulley groove that guides the hoisting rope 6 obliquely forward, outside the first end 17 of the rope drum as seen in the direction of the axle 11 of the rope drum, and to a distance from the vertical plane 14 of the hoisting arrangement. The hoisting rope 6 passes on to the sheave 7*a* above, to its flank further from the rope drum 5 (FIG. 1*a*). From the sheave 7*a*, the hoisting rope 6 descends to the second rope pulley 8*b* below, to its flank closer to the rope drum 5. From the second rope pulley 8*b*, the hoisting rope 6 ascends to the fixed attachment point 9 of the free end of the hoisting rope, arranged on the trolley 1.

The rotating axles 24*a-b* of the rope pulleys are parallel (FIG. 1*d-e*), and the discoidal planes 19*a-b* of the rope pulleys are mutually in parallel at an acute angle in relation to the vertical plane 14 of the hoisting arrangement. The rotating axles 24*a-b* are mutually at laterally deviated locations at a distance from each other, whereby the shape of the hoisting member 10, as a rope pattern, is made a parallelogram as seem from above, the extreme points of which are obtained on the basis of the entry points 16 and release points 15 of the hoisting rope 6, and a parallelogram may be chosen as the sturdy and advantageous shape for the frame of the hoisting member 26. The release point 15 of the second rope pulley 8*b* is thus also set to the vertical plane 14 of the hoisting arrangement. FIGS. 1*a-e* show an 1×4 roping.

The hoisting member 10 comprises, for example, rope pulleys with their axles and bearings, to compile a hook 25 and the frame 26 of the hoisting member as in the above. As seen from FIG. 1*c*, the vertical axis of the hoisting hook 25 of the hoisting member 10 is set below the sheave in the vertical and horizontal direction, and at the same time the load bearing capacity of the hoist structures may be made as large as possible.

FIGS. 1*d-e* show the rope pulley arrangement of the hoisting member, the frame 26 of the hoisting member, and the hoisting hook 25. The rope pulleys 8*a-c* and sheaves 7*a-b* provided with substantially the same diameters advantageously form a diamond shape for the roping. As seen in FIGS. 1*c*, 1*e*, the distance between the entry point 16 to the first rope pulley 8*a* of the hoisting rope and the release point 15 from the second rope pulley 8*b* of the hoisting rope 6 is larger than the distance between the entry and release points of the sheave 7*a*.

Figure 3A:
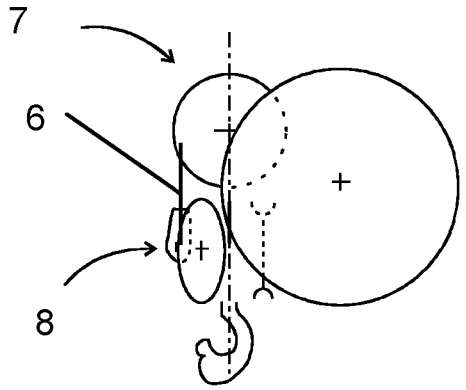
FIGS. 3*a-d* show a hoisting arrangement of a rope hoist.
Figure 3B:
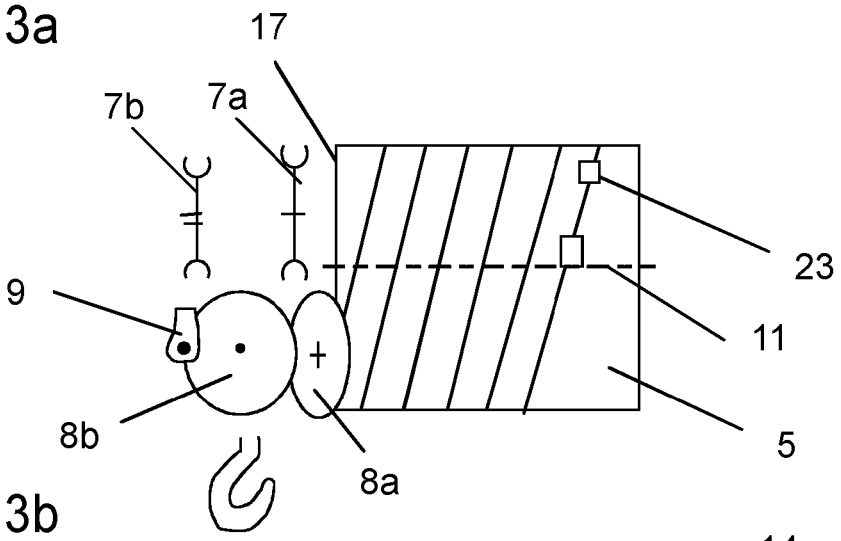

According to an embodiment, the rope pulley arrangement 8 also comprises a second rope pulley 8*b*, and the discoidal plane 19*b* of the second rope pulley 8*b* is arranged in parallel to the vertical plane 14 of the hoisting arrangement. FIGS. 3*a-d* show a solution in which the discoidal planes 19*a-b* parallel to the vertical plane of the rope pulley arrangement 8 are not in a mutually parallel position. FIG. 3*d* is a top view of the discoidal plane 19*a* arranged in the vertical direction of the first rope pulley 8*a*, which is arranged at an acute angle α in relation to the vertical plane 14 of the hoisting arrangement, and the discoidal plane 19*b* which is arranged in the vertical plane of the second rope pulley 8*b* and which is arranged parallel to the vertical plane 14 of the hoisting arrangement.

Figure 3C:
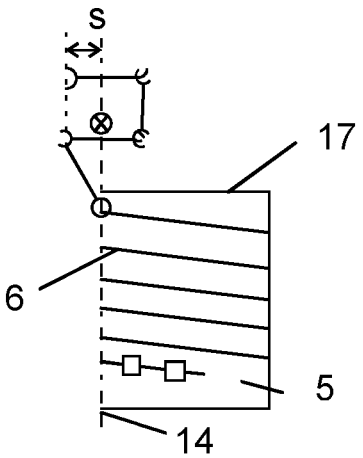
Figure 3D:
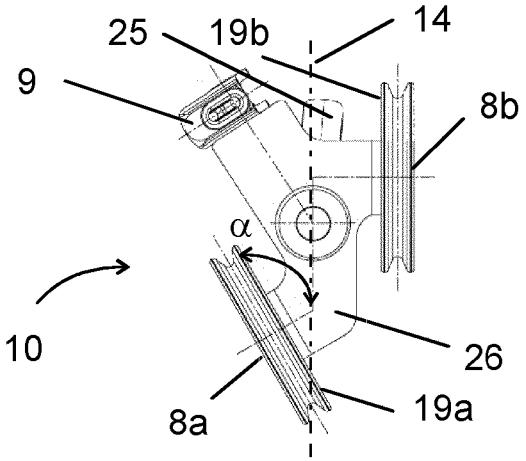

FIG. 3*c* is a top view of the hoisting arrangement. The hoisting rope is led from the rope drum 5 to the first rope pulley 8*a* having, on its outer edge, a rope pulley groove that guides the hoisting rope obliquely forward, in front of the first end 17 of the rope drum 5 as seen in the direction of the axle 11 of the rope drum, and to a distance s from the vertical plane 14 of the hoisting arrangement. The hoisting rope 6 passes further on to the sheave 7*a* above, to its flank further from the rope drum 5 (FIG. 3*a*). From the sheave 7*a*, the hoisting rope 6 descends to the second rope pulley 8*b* below, to its flank closer to the rope drum 5. From the second rope pulley 8*b*, the hoisting rope 6 further ascends to the second sheave 7*b* above. From the second sheave 7*b*, the hoisting rope 6 descends to the attachment point 9 of the free end of the hoisting rope on the hoisting member 10 (FIG. 3*d*).

FIG. 3*d* shows the rope pulley arrangement 8 of the hoisting member 10 according to FIGS. 3*a-c*, the frame 26 and hoisting hook 25 of the hoisting member as seen from above. The roping shown in FIGS. 3*a-d* is an 1×5 roping.

Figure 4A:
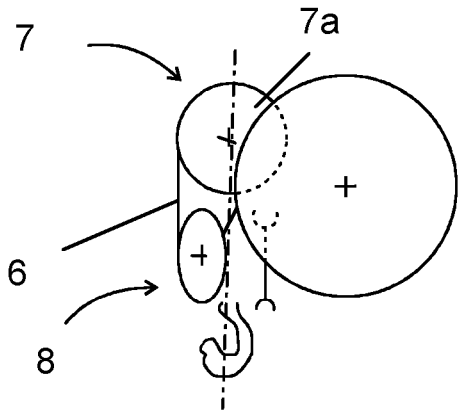
FIGS. 4*a-c* show a hoisting arrangement of a rope hoist.
Figure 4B:
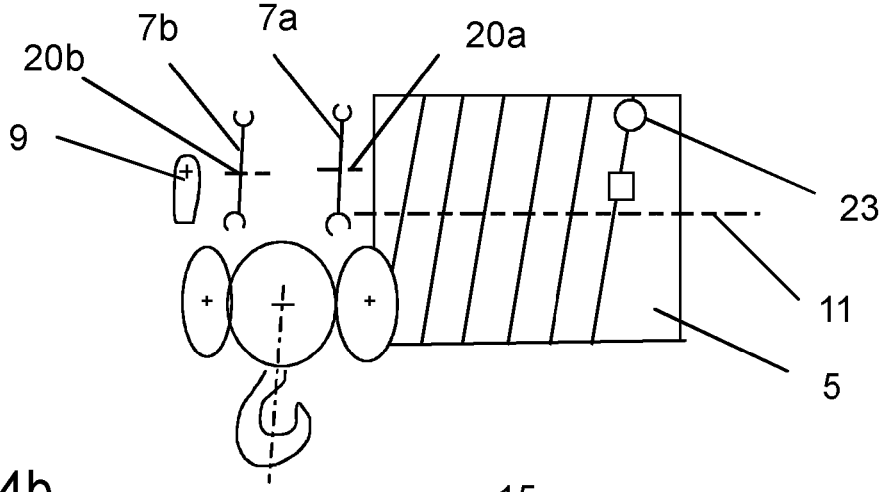
Figure 4C:
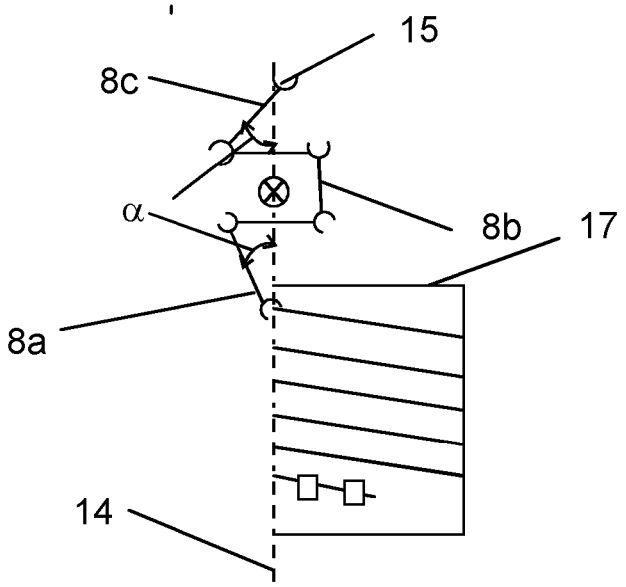

According to an embodiment, the rope pulley arrangement 8 additionally comprises a third rope pulley 8*c*, the discoidal plane 19*b* of which and the vertical plane 14 of the hoisting arrangement are at an acute angle α in relation to each other. FIGS. 4*a-c* show a solution in which the discoidal planes 19*a-c* arranged in the vertical direction of the rope pulleys are so arranged that the discoidal plane 19*a* of the first rope pulley is at an acute angle α in relation to the vertical plane 14 of the hoisting arrangement, the discoidal plane 19*b* of the second rope pulley is in turn parallel to the vertical level 14 of the hoisting arrangement, and the discoidal plane 19*c* of the third rope pulley is at an acute angle α in relation to the vertical plane 14 of the hoisting arrangement.

FIG. 4*c* is a top view of the hoisting arrangement. The hoisting rope 6 is led from the rope drum 5 to the first rope pulley 8*a* having, on its outer edge, a rope pulley groove that guides the hoisting rope 6 obliquely forward, outside the first end 17 of the rope drum as seen in the direction of the axle of the rope drum, and to a distance s from the vertical plane 14. The hoisting rope 6 passes on to the sheave 7*a* above, to its flank further from the rope drum (FIG. 4*a*). From the sheave 7*a*, the hoisting rope 6 descends to the second rope pulley 8*b* below, to its flank closer to the rope drum 5. From the second rope pulley 8*b*, the hoisting rope further ascends to the second sheave 7*b* above. From the second sheave 7*b*, the hoisting rope 6 descends to the third rope pulley 8*c* below, to its flank closer to the rope drum 5. The third rope pulley 8*c* is aslant in relation to the vertical plane 14 of the hoisting arrangement, advantageously so that its angle α in relation to the vertical plane 14 is substantially the same as that of the first rope pulley 8*a*, and the release point 15 of the hoisting rope 6 of the third rope pulley 8*c* is set at the vertical plane 14 of the hoisting arrangement. FIGS. 4*a-c* show an 1×6 roping.

According to an embodiment, the rotating axles 20*a-b* of the sheave or sheaves are parallel to the vertical plane 14 of the hoisting arrangement and are located on the vertical plane 14.

FIGS. 1*a-e* and 2*a-d* show a solution in which the axle 20*a-b* of the sheave is parallel to the vertical plane 14 of the hoisting arrangement and is located on the vertical plane. FIGS. 3*a-d* and 4*a-c* in turn show a two-sheave 7*a-b* solution in which the rotating axles 20*a-b* of both sheaves are parallel to the vertical plane 14 of the hoisting arrangement and are located on the vertical plane 14.

According to an embodiment, the sheave 7*a-b* has inside it a discoidal plane 21*a-b*, defined by its circumference, which is arranged in the vertical direction v, and the sheave arrangement comprise a first 7*a* and a second 7*b* sheave, and the discoidal planes 21*a-b* of the sheaves are arranged at an angle deviating from an acute angle in relation to the vertical plane 14 of the hoisting arrangement. By deviating the sheaves to an angular position it is possible to make the structure of the hoisting member more compact. FIGS. 5 and 6 show examples of the embodiments. The rope drum, rope pulleys and sheaves, as well as the attachment point of the hook of the hoisting member are seen from above in FIGS. 5 and 6.

FIG. 5 has an 1×5 roping, an odd number of roping. There are two sheaves and their discoidal planes 21*a-b* are arranged to an angle deviating from an acute angle in relation to the vertical plane 14 of the hoisting arrangement. The attachment point 22 of the hoisting member hook is arranged below the first sheave while at the same time being on the vertical plane 14 of the hoisting arrangement.

FIG. 6 has an 1×6 roping, an even number of roping. There are two sheaves and their discoidal planes 21*a-b* are arranged to an angle deviating from an acute angle in relation to the vertical plane 14 of the hoisting arrangement.

According to an embodiment, the release points 15 and entry points 16 between successive rope pulleys 8*a-c* and sheaves 7*a-b* are arranged so that the rope runs are substantially vertical. FIG. 1*a*, for example, show the hoisting rope passing substantially vertically from the rope pulley 8*a* of the rope pulley arrangement 8 to the sheave 7*a* of the sheave arrangement.

According to an embodiment, the attachment point 22 of the hoisting member is on the vertical plane 14 of the hoisting arrangement. FIG. 1*e*, for example, shows the vertical plane 14 of the hoisting arrangement drawn to the hoisting member 10, and the vertical plane 14 runs via the frame 26 of the hoisting member through the attachment point 22 of the hoisting hook 25.

According to an embodiment, the hoisting member 10 has the hoisting hook 25, the attachment point of which is arranged substantially at the height of the hub of the rope pulley 8*a-c* of the rope pulley arrangement 8. FIGS. 1*d-e* show the hoisting hook 25 on the hoisting member 10, the attachment point of which is arranged substantially at the height of the hub of the rope pulley 8*a-b* of the rope pulley arrangement 8. FIG. 1*d* shows the hoisting hook 25 arranged between the hubs of two rope pulleys 8*a-b*. The arm above the hoisting hook 25, its locking part such as a thwart, is adaptable between the rope pulleys 8*a-b*. The attachment point is advantageously between the rope pulleys 8*a-b* in the lateral direction, and in the height direction the attachment point is substantially at the level of the hubs of the rope pulleys 8*a-b*. With this solution for the vertical structure of the hoisting member 10, the hoisting height of the hoisting member may be made as large as possible.

According to an embodiment, when the hoisting member is at the upper position, the upper surface 28 of the rope pulleys 8 of the rope pulley arrangement is higher than the lower surface 27 of the rope drum. The solution presented in FIGS. 7*a-b* shows the rope pulleys of the rope pulley arrangement, the upper surface 28 of which is higher than the lower surface 27 of the rope drum. In the solution of FIGS. 7*a-b*, the rope pulley arrangement comprises two parallel rope pulleys, arranged mutually at an acute angle α in relation to the vertical plane 14 of the hoisting arrangement, and the sheave arrangement comprises a sheave. FIGS. 7*a-b* show an 1×4 roping.

According to an embodiment, the trolley 1 is one that moves under one main support 2, whereby the disengagement point 12 of the hoisting rope from the rope drum 5, at least the rotating axle 20*a-b* of the upper sheave arrangement 7 adjacent the rope drum 5, and the fastening point 22 of the hoisting member are at essentially the same vertical plane. FIG. 8 shows the trolley 1 from the direction of the main support. In the Figure, the vertical plane 14 is marked, where the disengagement point 12 of the hoisting rope from the rope drum 5 is located, at least the rotating axle 20*a-b* of the upper sheave arrangement adjacent the rope drum, and the fastening point 22 of the hoisting member.

The above embodiments may also have such a structure where the rope drum 5 is deviated to a gentle angle in relation to the horizontal, such as an angle of 0 . . . 4°. The deviation is carried out so that the second end 18 of the rope drum 5 is set lower in the vertical direction than the first end 17 of the rope drum 5. With this solution, the positioning of the hoisting rope 6 to its rope groove on the rope drum 5 may be further improved when the hoisting member 10 is at its upper position.

With the solution according to the invention, a small height dimension of the rope hoist is achieved, which enlarges the hoisting height. By placing the rope pulleys and sheaves as well as the rope drum in the mutual positions and locations set forth, they may be driven particularly close to each other beside each other at the upper position of the hoisting member. It is advantageous in the solution according to the invention that the rope pulleys and sheaves are wheels with essentially the same diameter, whereby their setting beside each other when the hoisting member is at the upper position is possible without their hitting each other, the rope drum, trolley, motor, switch, or control box of the hoist.

In the solution according to the invention, the angle of arrival of the ropes to the rope pulleys and sheaves are advantageous due to their positioning in relation to each other. The hoisting rope arrives at and exits the rope pulleys and sheaves so that the hoisting rope meets its groove in its direction of travel and laterally so that there is no harmful flank contact. Avoiding flank contact extends the life span of the wheels and rope and improves safety.

With the solution according to the invention, large rope forces may be avoided when the hoisting member is at the upper position even though the height dimension of the rope hoist is made shallow. Large rope forces are avoided because the rope angles do not become gentle due to the rope pulleys and/or sheaves installed aslant. This allows the use of conventional hoisting ropes instead of more expensive massive hoisting ropes.

With the solution of the invention, the unsteadiness of the hoisting member, hook, and rope pulleys is decreased when the hoisting member is at the upper position. In the sector below the rope pulley, the hoisting rope touches the rope pulley for a longer distance than previously. The central angle of the sector touched by the hoisting rope in the rope pulleys associated with the hoisting member is advantageously 150° . . . 180°.

The hoisting rope of the figures comprises an 1× roping, in which case the hoisting rope has n up-down pitches, where n is equal to 2, 3, 4, 5, or 6. With an odd number of ropes, in other words, for example, 3 or 5 up-down pitches of the rope, the attachment point of the hoisting rope is advantageously adapted to the hoisting member.

When the number of ropes is odd, as is the case with 1×3 and 1×5, the distances of the rope forces and lever arms affect how the location of the attachment point is chosen on the hoisting member 10. The number of rope forces is two in the case of a rope pulley, and one in the case of an attachment point. 1×3 rope forces are positioned approximately 180° on opposite sided, as in FIG. 2*d*, and the lever arm of the rope pulley is only one half of the lever arm of the attachment point. In an 1×5 roping, shown in FIGS. 3*a-d*, the directions of the forces are approximately at every 120°, and the lever arms of the rope pulleys are still smaller than the lever arm of the attachment point in FIG. 3*d*. By placing the hoisting hook 25 between these forces in relation to its attachment point 22, the hoisting member 10 is made into an symmetric device which stays vertical in all loading situations, and at the same time the desired change of direction of the rotating axle takes place between the rope pulleys 8*a-c* and sheaves 7*a-b*. In addition, the hoisting member 10 remains at the vertical level 14 of the hoisting arrangement and the hoisting member 10, too, may be hoisted advantageously high at its upper position.

Parts list: 1 trolley; 2 main support structure; 3 support frame structure; 4 bearing wheels; 5 rope drum: 6 hoisting rope; 7 upper sheave arrangement; 7*a-b* sheave; 8 lower rope pulley arrangement; 8*a-c* rope pulley: 9 attachment point; 10 hoisting member; 11 axle or rope drum; 12 disengagement point; 13; attachment point of sheave; 14 vertical plane of hoisting arrangement; 15 release point; 16 entry point; 17 first end; 18 second end; 19*a-c* discoidal plane of rope pulley; 20*a-b* rotating axle of sheave; 21*a-b* discoidal plane of sheave; 22 attachment point of hoisting member; 23 fastening; 24*a-c* rotating axle of rope pulley; 25 hoisting hook; 26 frame; 27 lower surface of rope drum; 28 upper surface of rope pulleys; s distance; v vertical direction; a angle.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A hoisting arrangement of a hoist of a crane, the hoisting arrangement comprising a trolley, arranged to move along a main support structure of the crane, whereby the trolley comprises:

a support frame structure;

bearing wheels which are fastened to the support frame structure and configured to move the trolley along said main support structure; and a hoisting mechanism comprising:

a rope drum for a hoisting rope, a rope pulley arrangement which has upper sheave arrangement and lower rope pulley arrangement and through which the hoisting rope is guided from the rope drum to an attachment point, and a hoisting member in cooperation with the hoisting rope for hoisting a load, wherein the rope drum is supported to the support frame structure of the trolley so that an axle of the rope drum is parallel to the main support structure, and wherein a disengagement point of the hoisting rope from the rope drum, an attachment point of a first sheave of the sheave arrangement, and the attachment point of the hoisting rope are arranged on a same vertical plane, wherein the rope drum has a first end towards which the hoisting rope is wound in the upper position of the hoisting member, and a second end towards which the hoisting rope is unwound in the lower position of the hoisting member, wherein a first rope pulley of the rope pulley arrangement is so placed that a release point of the hoisting rope from the first rope pulley to the first sheave is, in an axle direction of the rope drum, further from the second end than the first end of the rope drum, and wherein while the hoisting member is at the upper position, an upper surface of the rope pulleys of the rope pulley arrangement is at a higher level than a lower surface of the rope drum.

2. The hoisting arrangement as claimed in claim 1, wherein directions of the rotating axles of successive rope pulleys and sheaves substantially differ from each other.

3. The hoisting arrangement as claimed in claim 2, wherein the axle direction of the rope drum and an axle direction of the first rope pulley of the rope pulley arrangement substantially differ from each other.

4. The hoisting arrangement as claimed in claim 1, wherein a first discoidal plane is defined by a circumference of the first rope pulley, wherein the first discoidal plane is arranged in a vertical direction, and wherein the first discoidal plane and a vertical plane of the hoisting arrangement are at an acute angle in relation to each other.

5. The hoisting arrangement as claimed in claim 4, wherein the rope pulley arrangement comprises a second rope pulley having a circumference defining a second discoidal plane, and wherein the first discoidal plane and the second discoidal plane are arranged mutually in parallel to an acute angle in relation to the vertical plane of the hoisting arrangement.

6. The hoisting arrangement as claimed in claim 4, wherein the rope pulley arrangement comprises a second rope pulley having a circumference defining a second discoidal plane, and the second discoidal plane is arranged in parallel to the vertical plane of the hoisting arrangement.

7. The hoisting arrangement as claimed in claim 6, wherein the rope pulley arrangement additionally comprises a third rope pulley having a circumference defining a third discoidal plane, wherein the third discoidal plane and the vertical plane of the hoisting arrangement are at an acute angle in relation to each other.

8. The hoisting arrangement as claimed in claim 6, wherein each sheave of the sheave arrangement has a discoidal, which is defined by a circumference of each sheave, wherein each which discoidal plane is arranged in the vertical direction, and the sheave arrangement comprises the first sheave and a second sheave, and the discoidal planes of the sheaves are arranged at a 90° angle deviating from an acute angle in relation to the vertical plane of the hoisting arrangement.

9. The hoisting arrangement as claimed in claim 4, wherein the first rope pulley of the rope pulley arrangement is arranged at an angle of 20°-70° to the vertical plane of the hoisting arrangement.

10. The hoisting arrangement as claimed in claim 4, wherein the first rope pulley of the rope pulley arrangement is arranged at an angle of 40°-50° in relation to the vertical plane of the hoisting arrangement.

11. The hoisting arrangement as claimed in claim 1, wherein each rotating axle of each sheave of the sheave arrangement is parallel to the vertical plane of the hoisting arrangement and is located at the vertical plane.

12. The hoisting arrangement as in claim 1, wherein release points and entry points of the hoisting rope between successive rope pulleys of the rope pulley arrangement and sheaves of the sheave arrangement are arranged so that rope runs are substantially vertical.

13. The hoisting arrangement as claimed in claim 1, wherein an attachment point of the hoisting member is at a vertical plane of the hoisting arrangement.

14. The hoisting arrangement as claimed in claim 1, wherein the hoisting member has a hoisting hook, an attachment point of the hoisting hook arranged substantially at a height of a hub of a rope pulley of the lower rope pulley arrangement.

15. The hoisting arrangement as claimed in claim 1, wherein the trolley is configured to move under the main support structure whereby the disengagement point of the hoisting rope from the rope drum, at least the rotating axle of the upper sheave arrangement adjacent the rope drum, and an attachment point of the hoisting member are at essentially a same vertical plane.

16. The hoisting arrangement as claimed in claim 1, wherein the hoisting rope comprises 1× roping, in which case the hoisting rope has n up-down pitches, where n is equal to 2, 3, 4, 5 or 6.

17. The hoisting arrangement as claimed in claim 16, wherein when the number of roping is odd (n=3, 5), the attachment point of the hoisting rope is adapted to the hoisting member.

* * * * *